US007493738B2

(12) United States Patent
Bui

(10) Patent No.: US 7,493,738 B2
(45) Date of Patent: Feb. 24, 2009

(54) LIGHTWEIGHT MODULAR CEMENTITIOUS PANEL/TILE FOR USE IN CONSTRUCTION

(76) Inventor: Thuan H. Bui, 58 N. Mascher St., Philadelphia, PA (US) 19106

( * ) Notice: Subject to any disclaimer, the term of this patent is extended or adjusted under 35 U.S.C. 154(b) by 233 days.

(21) Appl. No.: 10/395,396

(22) Filed: Mar. 25, 2003

(65) Prior Publication Data

US 2004/0040257 A1 Mar. 4, 2004

Related U.S. Application Data

(63) Continuation-in-part of application No. 10/230,091, filed on Aug. 29, 2002.

(51) Int. Cl.
*E04C 2/32* (2006.01)

(52) U.S. Cl. ..... 52/783.11; 52/783.14; 52/783.17; 52/783.19; 52/798.1; 52/578; 52/579

(58) Field of Classification Search ..... 52/630, 52/783.11, 796.1, 596, 600, 602, 783.1, 783.14, 52/783.17, 783.18, 783.19, 798.1, 348–349, 52/578–581; 108/51.3
See application file for complete search history.

(56) References Cited

U.S. PATENT DOCUMENTS

| | | | | | |
|---|---|---|---|---|---|
| 2,689,988 | A | * | 9/1954 | French | 52/309.3 |
| 3,086,899 | A | * | 4/1963 | Ingraham et al. | 428/158 |
| 3,236,018 | A | * | 2/1966 | Graham et al. | 52/791.1 |
| 3,256,669 | A | * | 6/1966 | Seiwert | 52/789.1 |
| 3,258,892 | A | * | 7/1966 | Rushton | 52/789.1 |
| 3,419,457 | A | * | 12/1968 | Bleasdale | 428/124 |
| 3,568,390 | A | * | 3/1971 | Swensen et al. | 52/789.1 |
| 3,604,174 | A | | 9/1971 | Nelson | |
| 3,696,578 | A | * | 10/1972 | Swensen et al. | 52/789.1 |
| 3,744,194 | A | | 7/1973 | Ramberg | |
| 3,802,790 | A | * | 4/1974 | Blackburn | 404/82 |
| 4,077,170 | A | | 3/1978 | Van Der Lely | |
| 4,104,842 | A | | 8/1978 | Rockstead et al. | |
| 4,186,535 | A | * | 2/1980 | Morton | 52/250 |
| 4,189,877 | A | * | 2/1980 | Jentoft et al. | 52/58 |
| 4,472,919 | A | | 9/1984 | Nourse | |
| 4,507,901 | A | * | 4/1985 | Carroll | 52/302.3 |
| 4,594,833 | A | | 6/1986 | Mieyal | |

(Continued)

FOREIGN PATENT DOCUMENTS

| | | |
|---|---|---|
| CN | 86 1 04846 A | 12/1987 |

(Continued)

OTHER PUBLICATIONS

BNi Construction Dictionary, BNi Building News, 2001, BNi Publications, Inc. p. 628, 531.*

(Continued)

*Primary Examiner*—Jeanette Chapman
(74) *Attorney, Agent, or Firm*—Stein, McEwen & Bui, LLP; Hung H. Bui, Esq.

(57) ABSTRACT

A lightweight cementitious panel/tile is provided with increased bending stiffness and less weight than conventional construction panels. The cementitious panel is constructed of a cementitious surface (which may be reinforced with wood fiber or other materials) supported by an integrated stiffener grid on the underside to absorb stresses and loads.

34 Claims, 10 Drawing Sheets

U.S. PATENT DOCUMENTS 4,637,184 A * 1/1987 Radtke et al. ..... 52/220.4
4,699,822 A * 10/1987 Shu ..... 428/198
4,783,941 A * 11/1988 Loper et al. ..... 52/235
4,856,256 A * 8/1989 Tokuzo ..... 52/792.11
4,923,733 A * 5/1990 Herbst ..... 428/156
4,943,185 A * 7/1990 McGuckin et al. ..... 405/45
4,956,951 A * 9/1990 Kannankeril ..... 52/169.5
5,016,411 A * 5/1991 Thorsnes ..... 52/220.4
5,033,248 A 7/1991 Phillips
5,048,250 A * 9/1991 Elias ..... 52/437
5,052,161 A * 10/1991 Whitacre ..... 52/385
5,383,314 A * 1/1995 Rothberg ..... 52/169.5
5,404,687 A * 4/1995 Blake et al. ..... 52/600
5,453,313 A * 9/1995 Kiser ..... 428/143
5,460,867 A * 10/1995 Magnuson et al. ..... 428/178
5,489,462 A * 2/1996 Sieber ..... 428/174
5,525,399 A * 6/1996 Kiser ..... 428/141
5,566,522 A * 10/1996 Ålander et al. ..... 52/630
5,619,832 A * 4/1997 Myrvold ..... 52/403.1
5,634,309 A * 6/1997 Polen ..... 52/392
5,693,409 A * 12/1997 Gnatowski et al. ..... 428/212
5,775,039 A * 7/1998 McPherson ..... 52/169.5
5,820,296 A * 10/1998 Goughnour ..... 405/43
5,842,314 A 12/1998 Porter
5,927,034 A * 7/1999 Cole ..... 52/391
5,937,606 A 8/1999 Meier et al.
5,976,670 A * 11/1999 Fugazzi ..... 428/161
6,000,194 A * 12/1999 Nakamura ..... 52/783.17
6,101,779 A * 8/2000 Davenport ..... 52/602
6,151,854 A * 11/2000 Gutjahr ..... 52/385
6,155,013 A * 12/2000 Kim ..... 52/263
6,230,409 B1 5/2001 Billings et al.
6,256,957 B1 * 7/2001 Kelly ..... 52/413
6,260,329 B1 7/2001 Mills
6,269,608 B1 8/2001 Porter
6,286,279 B1 * 9/2001 Bean et al. ..... 52/390
6,324,812 B1 * 12/2001 Drya-Lisiecka ..... 52/783.11
6,330,776 B1 12/2001 Jinno
6,408,594 B1 6/2002 Porter
6,434,901 B1 * 8/2002 Schluter ..... 52/302.1
6,539,643 B1 * 4/2003 Gleeson ..... 33/563
6,539,681 B1 * 4/2003 Siegmund ..... 52/403.1
6,562,444 B1 * 5/2003 Gleeson et al. ..... 428/214
6,672,016 B2 * 1/2004 Janesky ..... 52/169.5
6,691,472 B2 * 2/2004 Hubert ..... 52/169.5
6,802,668 B2 * 10/2004 Parker ..... 405/49
6,817,151 B2 11/2004 Foderberg et al.
6,837,013 B2 1/2005 Foderberg et al.
6,922,857 B2 * 8/2005 Palma ..... 4/611
7,028,439 B2 4/2006 Foderberg et al.

FOREIGN PATENT DOCUMENTS

CN 2216551 Y 1/1996
DE 24 15 647 10/1975
WO WO 83/03276 9/1983

OTHER PUBLICATIONS

BNi Construction Dictionary, BNi Building News, 2001, BNi Publications, Inc. p. 628, 531.*
Office Action issued in Chinese Patent Application No. 03820442.8 on Dec. 29, 2006.
Search Report issued in European Patent Application No. 03791629 on Feb. 13, 2007.

* cited by examiner

LIGHTWEIGHT MODULAR CEMENTITIOUS PANEL/TILE FOR USE IN CONSTRUCTION

CLAIM FOR PRIORITY

This is a continuation-in-part (CIP) application from an application for "Lightweight Module Cemetitious Panel/Tile For Use In Construction" filed in the United States Patent & Trademark Office (USPTO) on Aug. 29, 2002, assigned Ser. No. 10/230,091.

FIELD

The present invention relates generally to structural building materials and, more specifically, relates to a lightweight structural element, in the shape of a plank, panel or tile, especially for building construction in the area of exterior wall or facade, decking, flooring, counter-top and roofing, containing an integrated support structure, in the form of a stiffener grid, provided for total weight and thickness reduction, while achieving high bending stiffness, durability, and modularity.

BACKGROUND

Currently, there are several types of materials that are used in building construction. Most commonly used are stone, wood, bricks, concrete, metal, and plaster and other materials. Many construction materials are available individually for assembly at the construction site, such as stone, wood, bricks etc., while others are assembled from pre-fabricates in a production factory, and then transported to the construction site as subassemblies, mostly in the form of various panels.

Pre-fabricated panels, made of steel reinforced concrete, have been widely used in the large-scale construction of houses and buildings. Panels, with insulating and other surface layers, are used to build complete houses, including roofs, ceilings, floors and backer-boards for ceramic tiles, thin bricks, thin stones, synthetic or natural stucco used in kitchens, bathrooms, shower rooms, corridors or any places that require water resistance and impact resistance. For wall systems, a wall joist structure (columns) is constructed and pre-fabricated panels may be attached to the joists. For flooring or roofing, a joist structure of beams is assembled and the pre-fabricated panels may be attached to the joists. For decking applications, pre-fabricated cement panels may be provided with a support structure to reduce the number of beams required to support the decking. However, cement panels can be extremely heavy.

Many pre-fabricated panels also incorporate pre-stressed and rebar reinforced cement/concrete products to increase high tensile strength and high bending strength. For example, high performance composite materials such as reinforcing fibers may be added to the surface of cement-based products to increase bending stiffness as described by Jinno et al., U.S. Pat. No. 6,330,776 entitled "Structure For Reinforcing Concrete Member And Reinforcing Method." Interior reinforcing metal strips or cross-bars can also be used to increase bending stiffness as disclosed, for example, by William H. Porter, U.S. Pat. No. 5,842,314, entitled "Metal Reinforcement of Gypsum, Concrete or Cement Structural Insulated Panels"; U.S. Pat. No. 6,269,608, entitled "Structural Insulated Panels For Use With 2× Stick Construction"; U.S. Pat. No. 6,408,594, entitled "Reinforced Structural Insulated Panels With Plastic Impregnated Paper Facings"; Meier et al., U.S. Pat. No. 5,937,606, entitled "Securing Of Reinforcing Strips"; and Billings et al., U.S. Pat. No. 6,230,409, entitled "Molded Building Panel and Method Of Construction". While the bending stiffness can be increased by reinforcing metal strips or cross-bars embedded in pre-fabricated panels, the overall weight of the pre-fabricated panels with sufficient stiffness and high bending strength remains a challenge. This is because embedding structural frameworks (metal strips or cross-bars) into cement can result in a heavy, thick construction using more cement product than is required. As a result, many panels still require a relatively thick plate for high load bearing applications. Moreover, materials used for prefabricated panels have been less than satisfactory in many respects, including their relatively high cost, heavy weight, structural deficiencies, and lack of resistance to elements.

Therefore, a need exists for a new structural building element, a lightweight pre-fabricated panel/tile provided with high stiffness, high bending strength without increasing overall weight for construction applications such as flooring, roofing, counter-top, decking, bridge surface, and wall systems.

SUMMARY OF THE INVENTION

Accordingly, it is therefore an object of the invention to provide a lightweight modular cementitious panel/tile designed for total weight and thickness reduction, while achieving high bending stiffness, durability, and modularity.

In accordance with one aspect of the present invention, a cementitious panel is provided with a plate made of a cementitious material; and a stiffener grid extended from the surface at an underside of the plate to transfer the stresses and loads placed on the plate to the underside grid.

The cementitious plate is made of fiber-reinforced cement, concrete or gypsum. Alternatively, the cementitious plate may be formed of a generally flat gypsum core sandwiched between layers of fiber-reinforced cement, concrete or gypsum. The cementitious plate can have protrusion on its sides to hide the underside stiffener grid. The stiffener grid is made of a metal sheet of galvanized steel (or of any type of appropriate corrosion resistant, stiff structural material) stamped, casted, or assembled from multiple hat sections into a single piece in a hat-section shape (or other shapes and configurations) having multiple stiffeners disposed on the cementitious plate to enhance stiffness and bending strength of the cementitious panel. The stiffener grid may have various dimensions, in terms of wall thickness, height, and patterning, as well as various shapes and configurations, depending on specifications and particular application. Such a stiffener grid may be joined to the cementitious plate by embedding an upper surface (flange) of the stiffener grid into a cementitious material forming the cementitious plate, when the cementitious material is cast into a panel form for curing. Alternatively, the stiffener grid may be joined to the cementitious plate, via fasteners or adhesives. Perforations may be required on the flange of the stiffener grid to enhance bonding between the stiffener grid and the plate, when the stiffener grid is joined through curing of a cementitious material forming the plate.

Optionally, an additional sheet of expanded metal mesh (or the like) may be spot welded or otherwise attached (such as, for example, tabs cut and projected from the flange of the stiffener grid to the flange of the stiffener grid to enhance the bonding or attachment between the stiffener grid and the cementitious material forming the plate. The stiffener grid may have means to facilitate its attachment to the building's structural frame works or joists. Examples of means to facilitate the attachment may include, but not limited to, a track assistance system and a tongue-and-groove system. With the track assistance system, the stiffener grid may have a number of rectangular holes in the bottom surface of its channels, so a separate track with integrated hooks or otherwise similar means, such as pins with epoxy, can latch and hold the tile/panel down in place. With the tongue and groove system, the side of the stiffener grid may have a tongue shape, so that the tongue side of the stiffener grid can lock into the adjacent tile. The stiffener grid may also have small gypsum or wood blocks place in the weak spots of the grid where the channels experience greatest compression force.

In accordance with another aspect of the present invention, a cementitious panel is provided with a plate made of a cementitious material; a stiffener system formed at an underside of the plate to increase bending stiffness to the panel and to provide a mechanism for attaching the panel to a building structure; and a top finishing layer applied to the cementitious material to provide both decorative and durability properties; wherein the cementitious material, the stiffener system and the top finishing layer are integrated with each other to create a single piece, used for modular construction.

The present invention is more specifically described in the following paragraphs by reference to the drawings attached herein below only by way of example.

BRIEF DESCRIPTION OF THE DRAWING(S)

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION

Example embodiments of the present invention are applicable for use with all types of support structures provided at the underside (bottom) of a cementitious plate to absorb high values of stress, from bending as well as from torsion loads, in horizontal and vertical directions, as well as all types of cementitious materials, including, but not limited to, fiber-reinforced cement, non-reinforced cement, concrete, cement reinforced with various other materials, cements made from fly ash, slag or sludge. However, for the sake of simplicity, discussions will concentrate mainly on modular cementitious panels or tiles having a cementitious plate and an integrated stiffener grid designed to absorb and transfer stresses and loads placed on the cementitious plate, although the scope of the present invention is not limited thereto. Such a cementitious panel/tile may be designed for use as a backer board for tile, thin brick, thin stones, synthetic or natural stucco, paint, exterior insulation and finish systems or other finishes that can be applied to concrete. Such cementitious panels/titles may also be available in a wide variety of dimensions (sizes/scales) and can have many applications, such as exterior decking, bridge decking, flooring, exterior or interior wall panels and facades, roofing, counter-top or other traditional and novel building applications. The term "cementitious" as used herein is to be understood as referring to any material, substance or composition containing or derived from cement or other pozzalonic materials.

Figure 1:
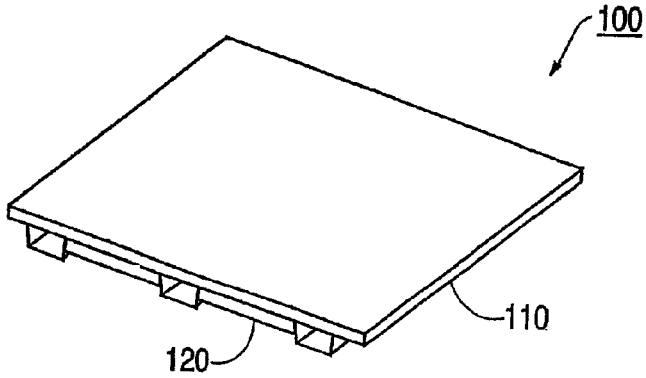
FIG. 1 illustrates an example modular cementitious panel/tile according to an embodiment of the present invention.

Attention now is directed to the drawings and particularly to FIG. 1, in which an example modular cementitious panel or tile for use in construction according to an embodiment of the present invention is illustrated. As shown in FIG. 1, the cementitious panel 100 comprises two primary elements: a cementitious plate 110 and a stiffening system 120 integrated with the cementitious plate 110 to create a single piece, which can be used for modular building or construction. The stiffening system 120 may be incorporated at an underside (bottom) of the cementitious plate 110 to provide high bending stiffness to the cementitious panel 100, and to provide a mechanism for joining or attaching these panels to the building structure. More specifically, the stiffening system 120 is designed to absorb and transfer high values of stress, from bending as well as from torsion loads, in both horizontal and vertical directions, placed on the cementitious plate 110 so that the cementitious plate 110 needs not be thick or heavy to withstand the stress load. As a result, the overall weight and thickness of the cementitious panel 100 can be significantly reduced, while the stiffness and bending strength can be optimized considerably.

Figure 2A:
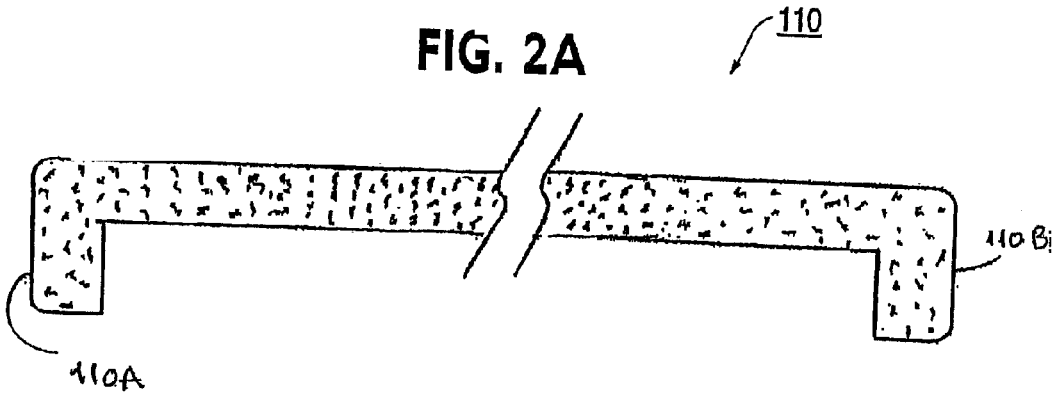
FIGS. 2A-2B illustrate an example cementitious plate according to various embodiments of the present invention.
Figure 2B:
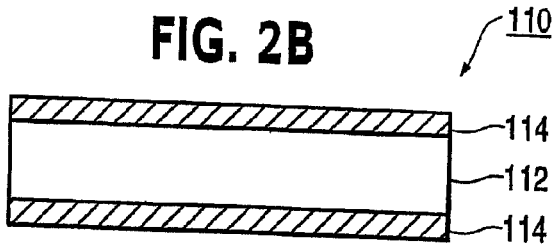

FIGS. 2A-2B illustrate an example cementitious plate 110 made according to various embodiments of the present invention. As shown in FIG. 2A, the cementitious plate 110 may be formed of a cementitious material made of fiber-reinforced cement to provide the cementitious panel 100 with high tensile strength. The cementitious material may also be a formulation of cement, gypsum, concrete with various aggregate, perlite, fibers, and suitable binder. The gypsum is preferably a high density gypsum composition that is commercially available in the market. The perlite may be in the form of an expanded perlite aggregate in plaster and concrete.

Alternatively, the cementitious plate 110 may be formed of a generally flat gypsum core 112 sandwiched between layers of fiber-reinforced cement 114, as shown in FIG. 2B. In many applications, one layer of fiber-reinforced cement positioned on one side of the cementitious plate 110 may be sufficient. In both embodiments shown in FIGS. 2A-2B, the cementitious plate 110 may have various dimensions, in terms of sizes and wall thickness, as well as various shapes and configurations, depending on the specifications and particular application.

In a preferred embodiment of the present invention, the cementitious material used may be smooth, or may have texture applied to thereto. Such a cementitious material may also be made from concrete, fly ash, or other durable exterior casting material. Wood fibers may then be used to reinforce the cement, concrete or gypsum because of their relatively low cost, lightweight, recyclable, and good thermal properties. However, other reinforcing fibers may also be available, such as carbon fibers, aramid fibers, glass fibers, polypropylene and the like. All reinforcing fibers or filaments may be disposed in the cement or gypsum in an organized or random fashion. In addition, other materials can also be used, including, for example, non-reinforced cement, concrete, cement reinforced with various other materials, cements made from fly ash, slag or sludge.

Referring back to FIG. 2A, the cementitious plate 110 may also have protrusion edges 110A-110B at its lateral sides to hide the underside of the stiffening system 120 and to provide an illusion of the thickness of the cementitious panel/tile 100.

Figure 3A:
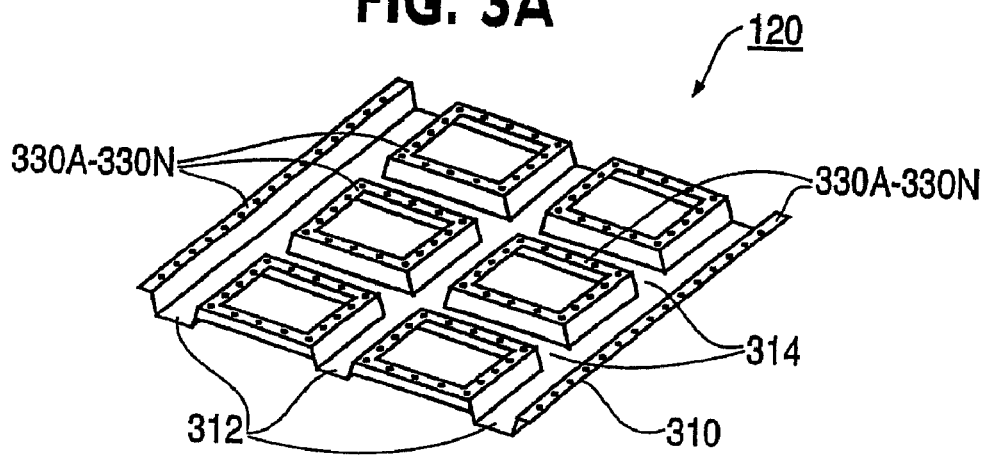
FIG. 3A illustrates an example stiffener system (i.e., stiffener grid) according to an embodiment of the present invention.

FIG. 3A illustrates an example stiffener system according to an embodiment of the present invention. As shown in FIG. 3A, the stiffening system 120 may be a stiffener grid made from a single piece of metal which can be stamped, casted or formed to shape by machine and then applied to the underside (bottom) of the cementitious plate 110. In a preferred embodiment of the present invention, the stiffener grid 120 may be formed from a galvanized steel sheet 310 stamped, casted or assembled from multiple hat section channels into a single piece of substantially the same size as that of the cementitious plate 110. For example, the galvanized steel sheet 310 may contain three hat-section channels 312 running in one direction and two hat-section channels 314 running in the other direction, all forming a stiffener grid 120.

However, the stiffener system 120 needs not be a stiffener grid shown in FIG. 3A. Other forms of stiffener mechanisms and hollow support structures may be utilized as long as the cementitious plate 100 is provided with high bending strength without increasing plate weight and thickness. The stiffener grid 120 may also be formed from any sheet of metal such as stainless steel, steel, and aluminum, or other corrosion resistant materials used to enhance the bending stiffness and reduce the weight of the cementitious panel 100, while providing a mechanism for joining or attaching these panels or tiles to the building structure. In addition, the stiffener grid 120 need not be arranged in the 3×2 stiffener configuration. Rather, any number of stamped stiffeners may be acceptable when designed to end-use. Likewise, the stiffener grid 120 need not use the hat-section configuration as shown in FIG. 3A. Rather, any other stiffener configurations or shapes, such as blade stiffeners, J-sections, and H-sections etc. may be used when designed to final application. The stiffener grid 120 can also have various dimensions in terms of wall thickness, height of stiffener, and patterning, depending on the specifications and particular application.

Figure 3B:
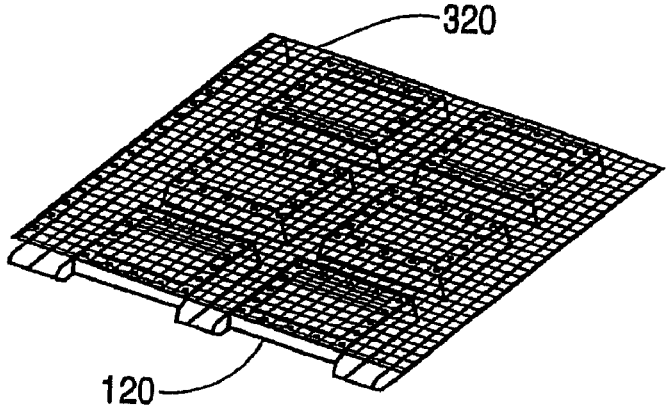
FIG. 3B illustrates an example stiffener grid with a sheet of expanded metal mesh, wire cloth or the like, attached onto the flange of the stiffener grid, forming a single piece according to an embodiment of the present of the invention.

FIG. 3B illustrates an example stiffener grid shown in FIG. 3A, including an additional expanded metal mesh or wire cloth forming a single piece according to an embodiment of the present invention. The stiffener grid configuration, as shown in FIG. 3B, has an additional expanded metal mesh (or wire cloth) 320 spot welded or otherwise attached to its flange. One example of such otherwise attachment is the use of tabs cut from the flange of the stiffener grid 120 to secure the metal mesh (or wire cloth) 320 in place. Such an expanded metal mesh 320 is advantageously designed for the cement embedding process, wherein, during the manufacturing process, the cementitious plate 110 may be cast with the stiffener grid in place. The expanded metal mesh 320 is also designed to help the attachment of the stiffener grid 120 into the cementitious plate 110, and reinforce the cementitious plate 110.

The expanded metal mesh 320 may be sheet metal that has been slit and stretched in different sizes, shapes and patterns such as square, cane, oval, diamond, triple diamond and interweave. Sheet metal may be lightweight, yet strong due to the truss pattern used to enhance the rigidity of the metal. These versatile sheets permit the stiffener grid 120 to bond with the cementitious plate 110 easily, and can be cut, formed and welded to suite any particular application.

Figure 4:
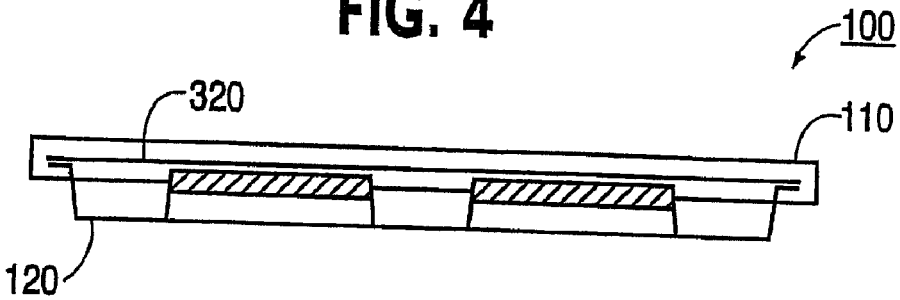
FIG. 4 illustrates a side view of an example modular cementitious panel including a cementitious plate and a stiffener grid according to an embodiment of the present invention.

FIG. 4 illustrates a side view of an example modular cementitious panel 100 shown in FIG. 1. The stiffener grid 120 may be joined to the cementitious plate 110 by embedding the upper surface (flange) of the stiffener grid 120 into the cementitious material, when the cementitious material forming the cementitious plate 110 is cast into a panel or tile form, via a mould, and remains uncured. The cement will flow through the flange's perforations 330A-330N and, optionally, the expanded metal sheet 320 as shown in FIG. 3B, and will cure in place. The cement may then be pressed with the stiffener grid 120 in place to increase inter-laminar bond strength. The cement product may have decorative or functional texture applied to upper surface, such as wood texture, or others.

Alternative methods for joining the stiffener grid 120 to the cementitious plate 110 may include the use of bumps instead of or in addition to perforations on the stiffener grid 120 while curing the cement. Other alternatives allow for forming the cement product independently and attaching the stiffener grid 120 through the use of adhesives or mechanical fastening means. Adhesive can be urethane or epoxy cement, glue or a mastic coating. Other mechanical fastening means can also be used, such as screws, nails, bolts, rivets, pins, loops and the like in the structure or the structural component, respectively, or the cement product.

Figure 5:
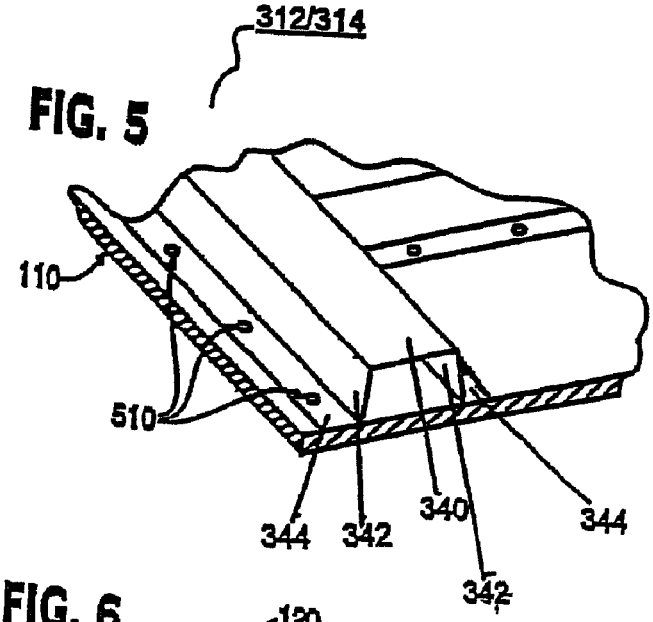
FIG. 5 illustrates an example method of joining the stiffener grid to the cementitious plate using fasteners according to an embodiment of the present invention.

For example, FIG. 5 illustrates an example method of joining the stiffener grid 120 to the cementitious plate 110 using fasteners according to an embodiment of the present invention. As shown in FIG. 5, mechanical fasteners such as screws or nails 510 may be used to attach the hat-section channels of the stiffener grid 120 to the cementitious plate 110, such as a hat-section channel 312 running in one direction or another direction, as shown, for example, in FIG. 3A. If mechanical fasteners are used, then the cementitious plate 110 may contain a surface edge reinforcement layer that is relatively strong and hard such that a screw or a nail may be driven through the edge of the cementitious plate 110 without pre-drilling and/or without breakage. As shown in FIG. 5, each hat-section channel 312 (or 314) includes a substantially flat base member 340, side members 342 extending upwardly from opposite sides of the base member 340, and flanges 344 extending generally laterally outwardly from the side members 344, respectively. The flanges 344 are coupled to the underside of the cementitious plate 110, without interfering with its shear or stress strength, so that the base member 340 can be extended and spaced apart from a surface of the underside of the cementitious plate 110.

Figure 6:
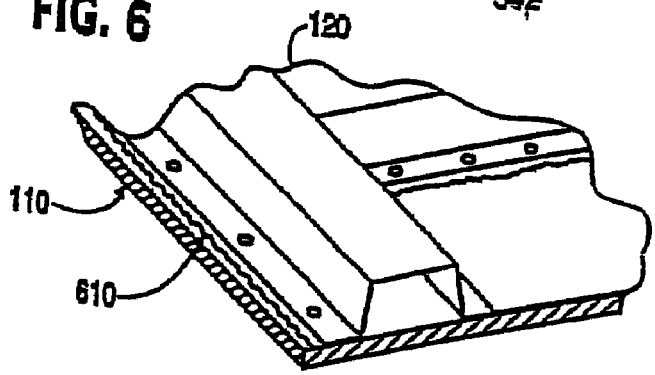
FIG. 6 illustrates an example method of joining the stiffener grid to the cementitious plate using adhesives according to another embodiment of the present invention.

FIG. 6 illustrates an example method of joining the stiffener grid 120 to the cementitious plate 110 using adhesives according to another embodiment of the present invention. As shown in FIG. 6, adhesives such as urethane or epoxy cement, glue or mastic coatings may be used to attach the stiffener grid 120 to the cementitious plate 110. If adhesives are used, then the cementitious plate 110 may be pressed with the stiffener grid 120 in place until cured to increase inter-laminar bond strength.

Figure 7:
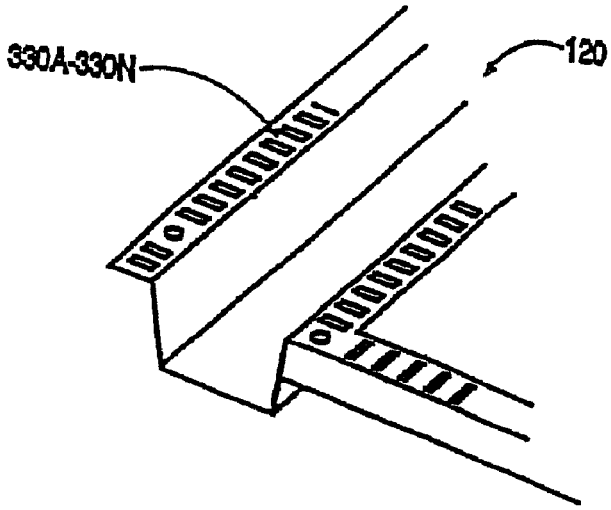
FIG. 7 illustrates an example stiffener grid in which perforations are used to enhance bonding with the cementitious plate according to an embodiment of the present invention.

FIG. 7 illustrates an example stiffener grid 120 in which perforations 330A-330N are used to enhance bonding with the cementitious plate 110 according to an embodiment of the present invention. As shown in FIG. 7, the edge of the stiffener grid 120 is perforated with openings (perforations). As a result, when the stiffener grid 120 is joined with the cementitious plate 110 through curing the cementitious material, the inter-laminar bonding between the stiffener grid 120 and the cementitious plate 110 can be significantly improved.

Figure 8:
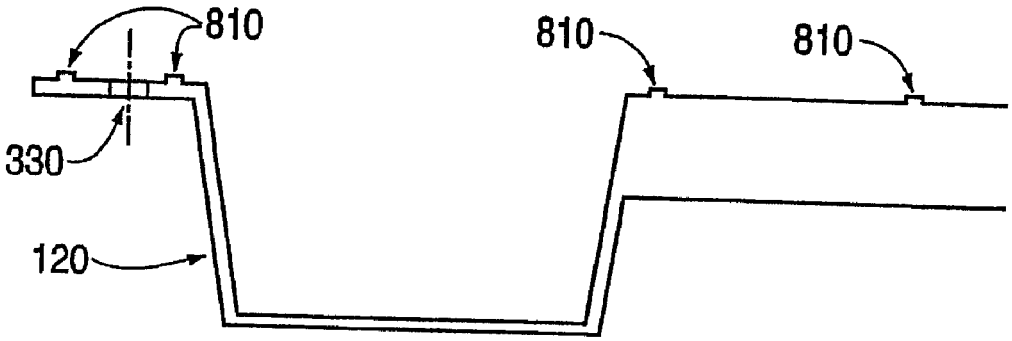
FIG. 8 illustrates an example stiffener grid in which elevated elements are used to enhance bonding with the cementitious plate according to another embodiment of the present invention.

FIG. 8 illustrates an example stiffener grid 120 in which elevated elements such as bumps are used to enhance bonding with the cementitious plate according to another embodiment of the present invention. As shown in FIG. 8, elevated bumps 810 are positioned on the flange (upper surface) of the stiffener grid 120 in an organized or random fashion. These bumps 810 are used in addition to the perforations 330A-330N on the flange of the stiffener grid 120 in order to ensure bonding with the cementitious plate 110, particularly when the cement flows through the perforations 330A-330N of the flange during curing.

Figure 9:
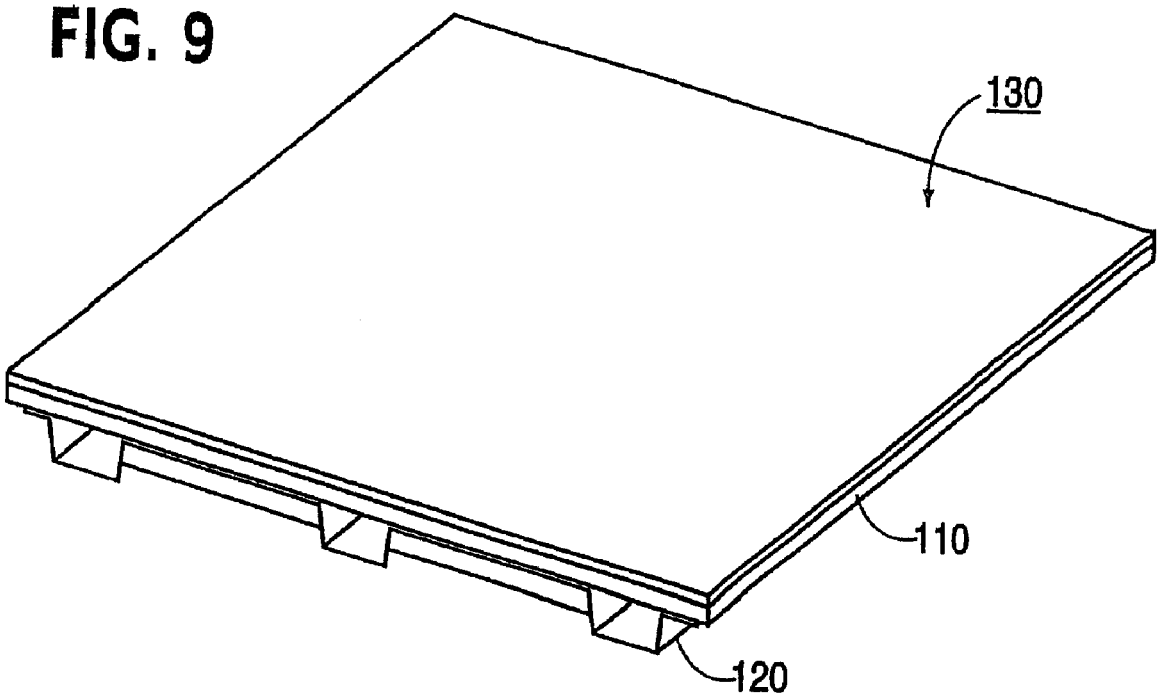
FIG. 9 illustrates an example modular cementitious panel including a cementitious plate, a stiffener grid and a final coating of a decorative material assembled according to an embodiment of the present invention.

FIG. 9 illustrates an example modular cementitious panel 100 according to another embodiment of the present invention. As shown in FIG. 9, the modular cementitious panel 100 comprises three primary elements: a cementitious plate 110, a stiffener grid 120 joined to the cementitious plate 110, and a top finishing layer 130 applied to the upper surface of the cementitious plate 110. All three primary elements are integrated with each other to create a single piece, which can be used for modular building or construction, including interior flooring, exterior decking and wall system.

In a preferred embodiment of the present invention, the top finishing layer 130, which can be applied to the cementitious material, is a simple spray coated polymer or another cementitious layer that is designed to address functions such as the decorative and durability properties of the panel/tile as a whole. For example, the top finishing layer 130 may be an epoxy-based cement layer pigmented for decorative reasons, with a thin coat of concrete sealer on top of the epoxy-based cement layer. The epoxy-based cement used here can provide extreme wear resistance; and the cement sealer can waterproof the epoxy-based cement layer.

The top finishing layer 130 can be adjusted and finished in a wide variety of ways, thus giving the final construction different features. Furthermore the material used can be extremely resistant to elements, fireproof, waterproof, and possibly even watertight. For instance, the cementitious plate 110 may be spray-coated with a waterproofing mixture and cured as required. The waterproofing coating can be obtained from the compositions including various groups of polymers. The polymers, which can be used for this purpose, include: poly(vinyl chloride) (PVC), polyurethane (PU), acrylic resins (AR), and other polymers which have waterproof properties. Additional examples include polymer-modified bitumens, alkyd resins, epoxy resins (EP), silicone resins which are not discussed but can also be used within the framework of the present invention.

Figure 10:
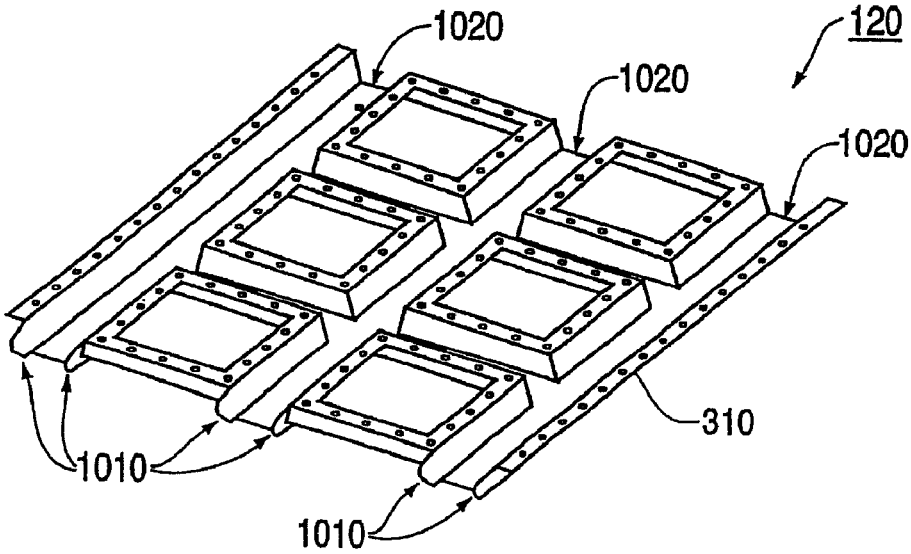
FIG. 10 illustrates an example stiffener grid for easy assembly according to an embodiment of the present invention.

For the convenience of assembly, the cementitious panel 100 may have various configurations that include means for attachment to other cementitious panels. For example, FIG. 10 illustrates an example stiffener grid made for easy assembly according to an embodiment of the present invention. As shown in FIG. 10, the preferred attachment means to join cementitious panels together is a tongue and groove interlocking connection system. In one embodiment of the present invention, tougues 1010 may be formed in the channels 312 at one side (a distal end along a lateral direction), for example, a left side of each cementitious panel 100, while the grooves (not shown) may be formed in the channels 312 at the other side (an opposite distal end along a lateral direction), for example, a right side of each cementitious panel 100. This way, when the cementitious panels are arranged side-by-side, the tougues 1010 of one cementitous panel (such as 100A, shown in FIG. 11) will project into the corresponding grooves (not shown) of the other cementitious panel (such as 100B, shown in FIG. 11) to provide a tougue and groove interlocking connection.

Figure 11:
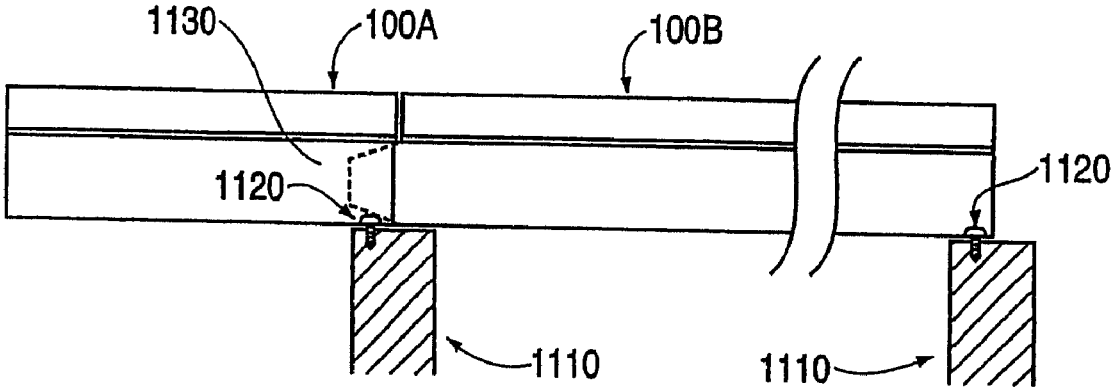
FIG. 11 illustrates an example assembly of modular cementitious panels according to an embodiment of the present invention.

The example stiffener grid 120 may also include selected openings 1020 in the channels 312 at the other side, for example, the right side of the cementitious panel 100. These openings 1020 are used to enable fasteners 1120 such as screws or nails to fasten or secure the cementitious panel (for example, 100A) to the framing joist 1110 as shown in FIG. 11. When the cementitious panel 100A is secured on the framing joist 1110, the tougues 1010 extending from the channel members 340 of the stiffener grid 120 of another cementitious panel 100B may be inserted into the grooves 1130 of the secured cementitious panel 100A. After the tougue and groove interlocking connections are made, the fasteners 1120 may be used to secure the second cementitious panel 100B onto another framing joist 1110.

Figure 12A:
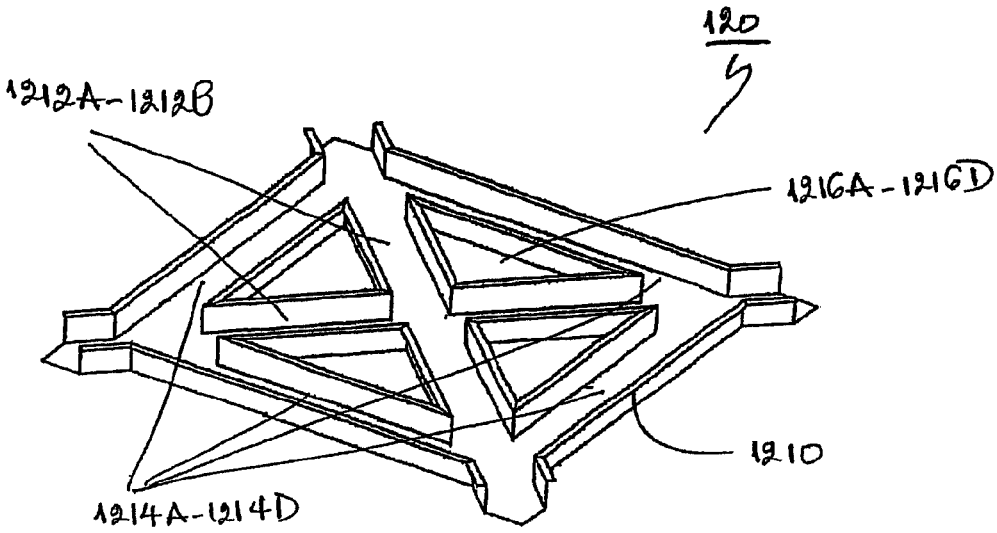
FIG. 12A illustrates an example stiffener grid having channels in a cross pattern according to another embodiment of the present invention.
Figure 12B:
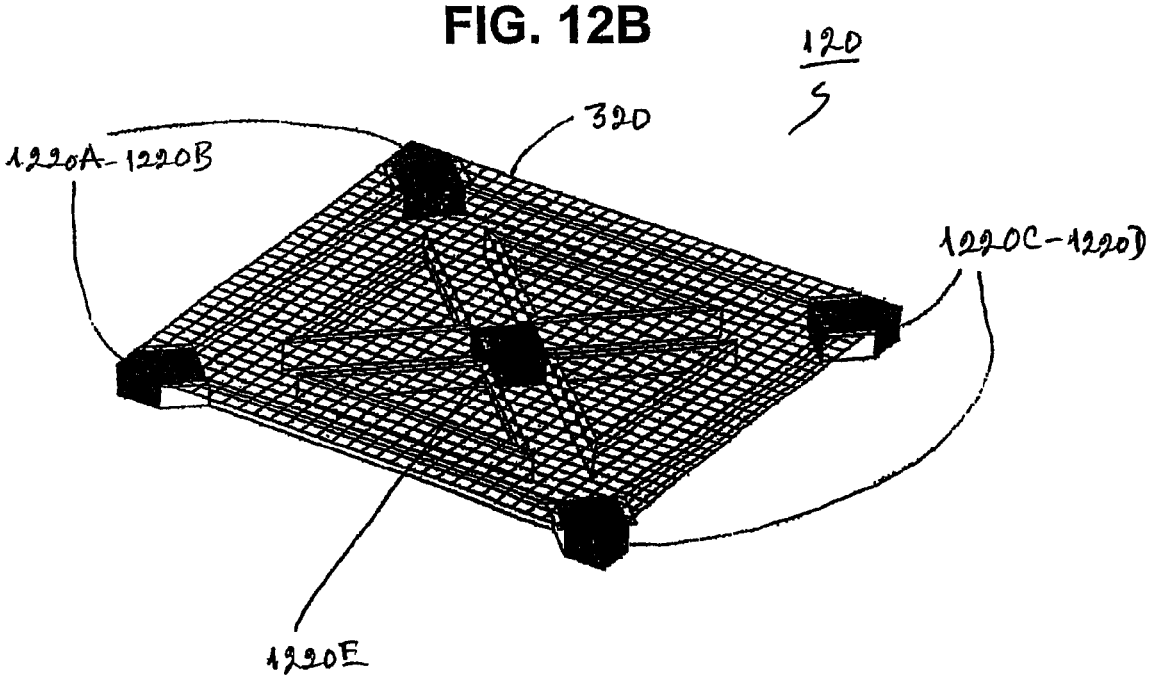
FIG. 12B illustrates an example stiffener grid having channels in a cross pattern with inserted gypsum blocks and a single sheet of expanded metal mesh attached onto the flange of the stiffener grid, forming a single piece according to another embodiment of the present of the invention.

Turning now to FIGS. 12A-12B, another example stiffener system according to another embodiment of the present invention is shown. The stiffener system shown in FIGS. 12A-12B, may be an alternative to the stiffener system shown in FIGS. 3A-3B. Specifically, FIG. 12A illustrates an example stiffener system provided with a stiffener grid 120 made from a single piece of metal of substantially the same size as that of the cementitious plate 110, stamped, casted or assembled in an "X" configuration, and then applied to the underside (bottom) of the cementitious plate 110, shown in FIG. 1. The metal piece 1210 may contain two stamped or casted channels 1212A-1212B running in diagonal (criss-cross) directions and four stamped or casted channels 1214A-1214D running in vertical and horizontal directions, all in an "X" configuration, leaving individual stiffeners 1216A-1216D in a substantially rectangular shape between the stamped or casted channels 1212A-1212B and 1214A-1214D.

FIG. 12B illustrates an example stiffener grid 120, shown in FIG. 12A, provided with an additional expanded metal mesh 320 spot welded or otherwise attached, for example, by way of tabs, to its flange. Such an expanded metal mesh 320 is advantageously designed for the cement embedding process, wherein, during the manufacturing process, the cementitious plate 110 may be cast with the stiffener grid in place. The expanded metal mesh 320 is also designed to help the attachment of the stiffener grid 120 into the cementitious plate 110, and reinforce the cementitious plate 110.

The expanded metal mesh 320 may be a sheet metal that has been slit and stretched in different sizes, shapes and patterns such as square, cane, oval, diamond, triple diamond and interweave. Sheets may be lightweight, yet strong due to the truss pattern to enhance the rigidity of the metal. These versatile sheets permit the stiffener grid 120 to bond with the cementitious plate 110 easily, and can be cut, formed and welded to suite any particular application.

In addition, the stiffener grid 120 can be provided with means to efficiently strengthen the weakest spots in the underlying grid. For example, in some of the side surface of its channels where the stiffener grid 120 experiences greatest compression force, for example, at respective corners and at a center of the stiffener grid 120, as shown in FIG. 12B, compression blocks 1220A-1220E can be inserted and located in the channels at the respective corners and at the center of the stiffener grid 120 to alleviate stress and relieve the compression force, while concomitantly reinforcing the stiffener grid 120. These compression blocks 1220A-1220E can be made of gypsum or any material that has great compression property.

Figure 13:
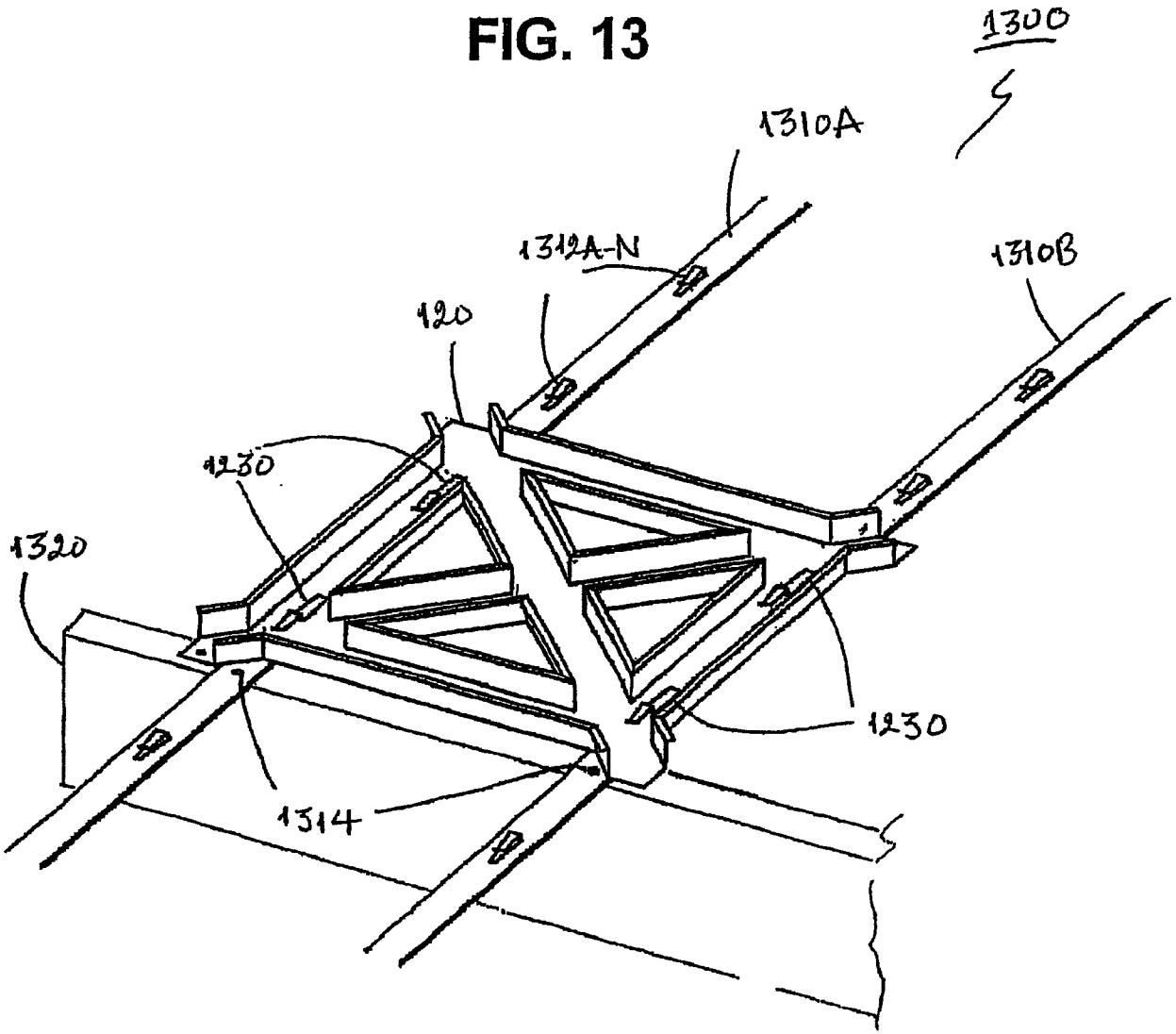
FIG. 13 illustrates an example track system implemented to help the attachment of the cementitious panel or tile according to another embodiment of the present invention.

FIG. 13 illustrates an example track system implemented to facilitate the attachment of the modular cementitious panel or tile according to another embodiment of the present invention. For purposes of clarity and brevity, the cementitious plate 110 is not shown. Only the stiffener grid 120 is shown to illustrate visually the attachment of the modular cementitious panel or tile 100, shown in FIG. 1, onto a track system. However, in actuality, the cementitious plate 110, with the protrusion edges 110A-110B, as shown in FIG. 2A, for example is on top of the stiffener grid 120.

As shown in FIG. 13, the track system 1300 includes as many individual tracks 1310 as required to assemble as many individual modular cementitious panels or tiles 100. For example, if a single modular cementitious panel or tile 100 is to be installed, two adjacent tracks 1310A-1310B are required to secure the cementitious panel or tile 100 in place. Multiple frames or joists 1320 may be required to provide support for the tracks 1310A-1310B. Each track is provided with integrated hooks 1312A-1312N to help its installation. For example, the tracks 1310A-1310B may be fastened to the structural joists or frame 1320, and then the modular cementitious panel or tile 110 can be snapped or slided in place through selected openings (holes) 1230A-1230N of the stiffener grid 120. The tracks 1310A-1310B also contain screw holes 1314A-1314N for enabling the tracks 1310A-1310B to be fastened down onto the frame or joist 1320, via respective corners.

Again, there are other types of connections can also be used to interconnect the modular cementitious panels or tiles, and to facilitate the attachment of the modular cementitious panels or tiles onto a track system, as shown in FIG. 13. For example, cooperating hinge barrels welded to the sides of the cementitious panels may be used, such that when panels are positioned in a side-by-side relationship, hinge barrels will be in alignment and a hinge pin can be inserted to lock panels together. The hinge barrel arrangement allows for rapid connection of panels, particularly when the panels are used for temporary or semi-temporary construction. If desired, waterproofing mastic or other such material, can be injected into any space remaining between the hingedly interconnected panels. Alternatively, track systems using multiple tracks in either U-shape or hat-shape, provided with fixed or movable pins and/or fastening clips so that the modular cementitious panels or tiles can be snapped or secured in place through selected openings (holes) of the stiffener grid.

Figure 14:
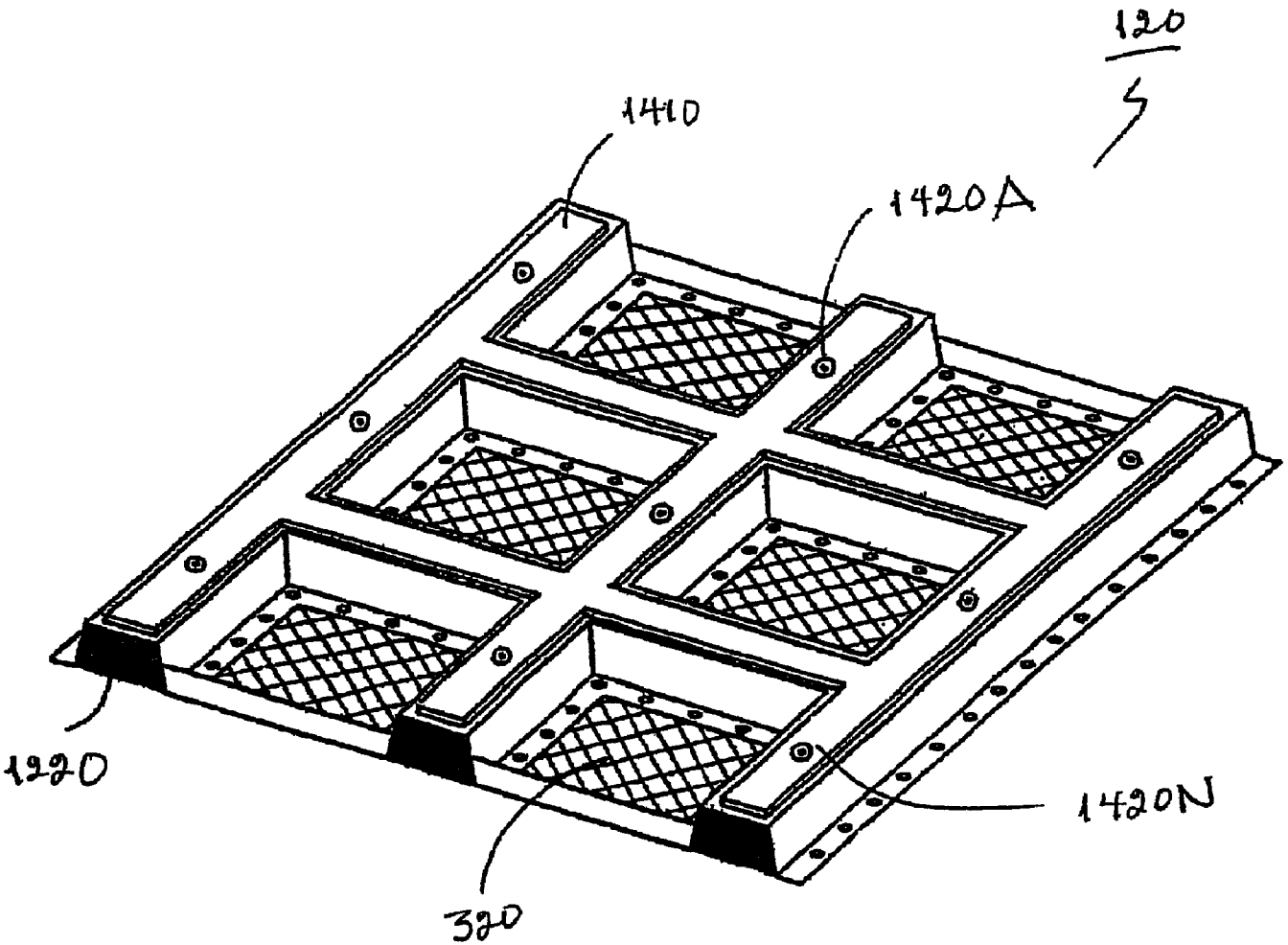
FIG. 14 illustrates another example stiffener grid having stiffeners reinforced in areas where the stress load is greatest according to yet another embodiment of the present invention.

Turning now to FIG. 14, another possible reinforcement is provided to reinforce the stiffness and bending strength of the modular cementitous panel or tile according to an embodiment of the present invention. As shown in FIG. 14, the stiffener system used for illustration purposes is the stiffener grid 120 shown in FIGS. 3A-3B provided with an expanded metal mesh (or wire cloth) 320. In order to alleviate stress experienced at the bottom surface of the stiffener grid 120, a flat metal stock 1410 may be attached to the underside (bottom surface) of the channel grids where the stiffener grid 120 experiences the greatest stress by means of rivets 1420 or spot welding. The flat metal stock 1410 can be configured to have the same shape as the underside of the channel grids of the stiffener grid 120. Alternatively, the flat metal stock 1410 can be individual flat metal pieces that can be attached to one or more selected areas of the underside of the channel grids of the stiffener grid 120 where those selected areas are weakest in order to reduce the overall stress. The flat metal stock 1410 can be made of aluminum or the same material as the stiffener grid 120, and shaped as the stiffener grid 120 as shown in FIG. 14. In addition, individual compression block 1220 may be inserted into the channels at respective distal ends, or selected areas of the stiffener grid 120 to alleviate stress and relieve the compression force, while concomitantly reinforcing the stiffener grid 120. As described in connection with FIG. 12B, the compression blocks 1220 can be made of gypsum or any material that has great compression property.

As discussed with reference to FIGS. 1 and 9, the fiber reinforced cement, or gypsum provides the cementitious panel 100 with high tensile strength, and the stiffener grid 120 provides the modular panel 100 with high bending strength without increasing panel weight and thickness. The example stiffener grid 120 shown in FIGS. 3A-3B and FIGS. 12A-12B provides an increase in stiffness and bending strengths of the cementitious panel on the order of at least 2 or 3 times (200% or 300%) over the strength of non-stiffener reinforced panels.

In order to validate the overall concept of an integrated stiffener system, commercially available fiber-reinforced cement panels were tested in a flexural load condition using both a concentrated load (a 2" long, 0.25" diameter pin) and a distributed load (~10 $in^2$ circular plate). The stiffened cementitious panels were produced with the same fiber-reinforced cement panel as the plate material and also tested for the same properties. The stiffened cementitious panels were tested with the concentrated load between two (2) stiffeners and again with the concentrated load centered on one (1) stiffener.

The results of this test indicate dramatic increases in load to failure and bending stiffness of the stiffened panels. It should be noted that the stiffeners were not optimized in any way to provide specific performance goals, but rather assembled to validate the overall concept.

Figure 15:
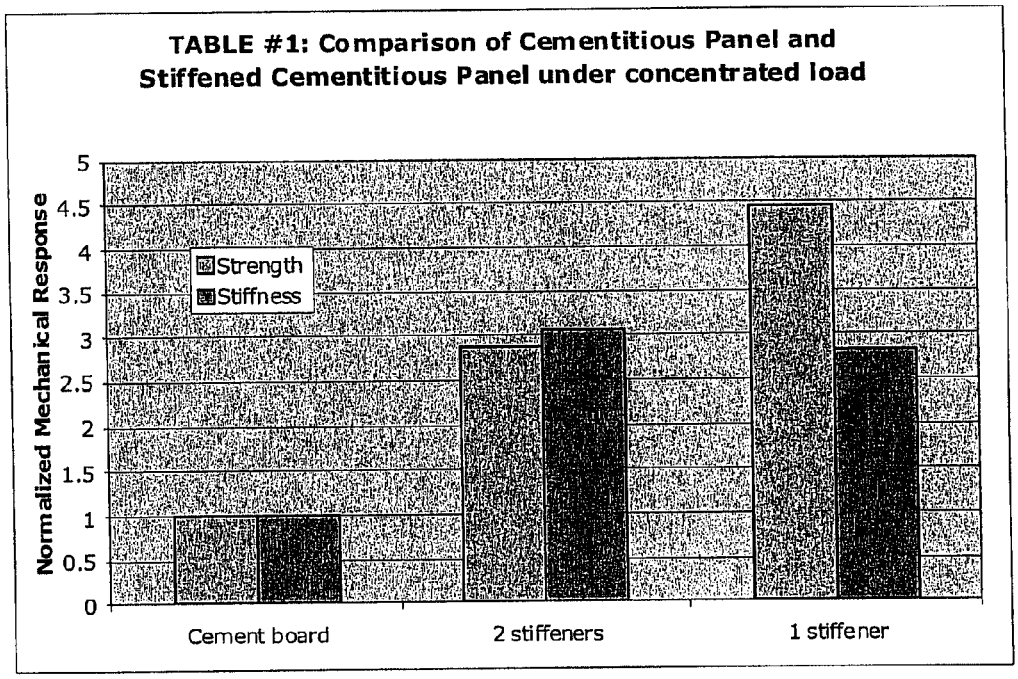

FIG. 15 shows Table #1 which illustrates a comparison of the concentrated pin load flex results on the different systems. In this table, the strength and stiffness values were normalized to the values of the cenentitious panel, and the term "2 stiffeners" indicates that the concentrated load was located between two (2) stiffners, and the term "1 stiffner" indicates that the concentrated load was centered on one (1) stiffner.

As shown in FIG. 15, Table #1 provides a comparison of commercially available cementitious panel and stiffened cementitious panel according to an embodiment of the present invention under concentrated load.

Figure 16:
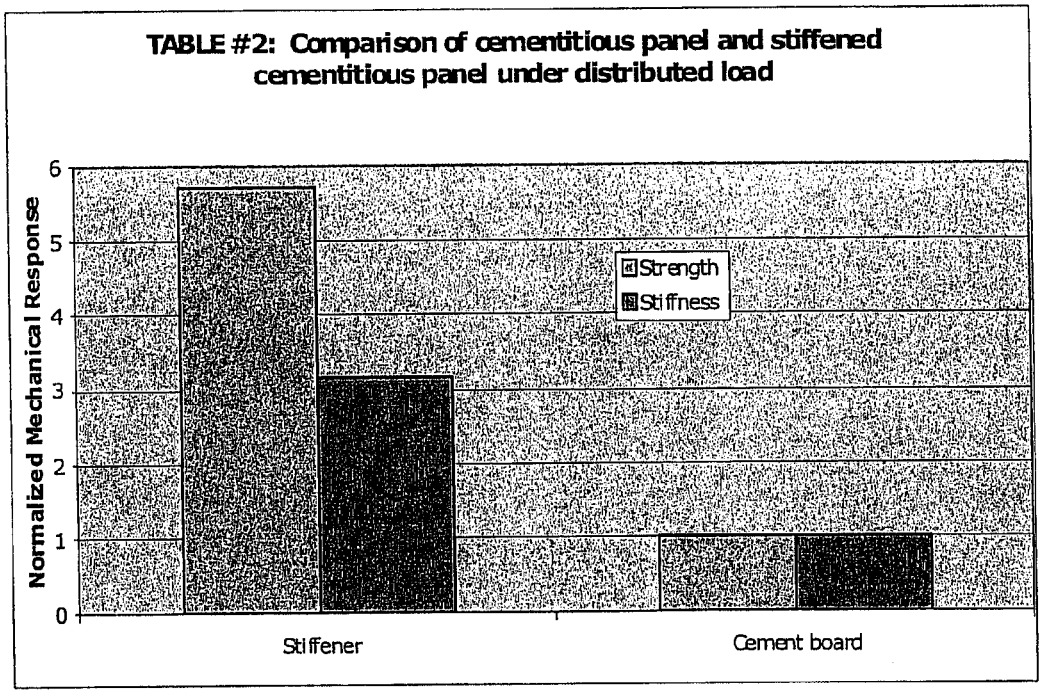

In contrast to FIG. 15, FIG. 16 shows Table #2 which illustrates a comparison of distributed load flex results for the commercially available cementitious panel and the stiffened cementitious panel according to an embodiment of the present invention. In this case, the distributed surface was larger than the distance between the stiffeners, so it was not necessary to distinguish "2 stiffeners" from "1 stiffener".

As shown in FIG. 16, Table #2 shows a comparison of commercially available cementitious panel and stiffened cementitious panel according to an embodiment of the present invention under distributed load.

The advantage of this lightweight stiffener solution lies in the high value of bending strength of the lightweight stiffener element caused by the fact, that the entire lightweight modular cementitious panel according to this invention behaves as a single entity, because the stiffener grid is firmly attached to the cementitious plate and therefore all internal and external stresses and loads are transferred from the cementitious plate to all the components of the stiffener grid. Thus it is possible to exploit this lightweight modular cementitious panel for walls as well as for floors, decking, wall, ceilings, counter-tops or roofs. In addition, the modular cementitious panels according to the present invention are light, inexpensive, durable, compact for storage, strong. Modular cementitious panels/tiles may also be provided with openings for electrical and other installations embedded therein.

As described from the foregoing, the present invention advantageously provides a method of constructing a lightweight cementitious panel/tile that has much greater bending stiffness and many times less weight than commercially available cementitious panel/tile. The design of such panels/tiles in various scales can have many applications, including exterior decking, bridge decking, flooring, exterior or interior wall panels, roofing, counter-tops or other traditional and novel building applications. The essence of the construction is a cement surface (which may be reinforced with wood fiber or other materials) supported by an integrated stiffener grid on the underside to reduce the overall weight and thickness of the cement surface, while effectively withstanding stresses and loads asserted thereon.

While there have been illustrated and described what are considered to be example embodiments of the present invention, it will be understood by those skilled in the art and as technology develops that various changes and modifications may be made, and equivalents may be substituted for elements thereof without departing from the true scope of the present invention. Accordingly, all such modifications may be made to adapt the teachings of the present invention to a particular situation without departing from the scope thereof. Therefore, it is intended that the present invention not be limited to the various example embodiments disclosed, but that the present invention includes all embodiments falling within the scope of the appended claims. In the claims, means-plus-function clauses are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A modular panel comprising:

a cementitious plate; and a stiffener system provided at an underside of the cementitious plate, and comprising a plurality of elongated, spaced-apart hat-section channels running vertically and horizontally to provide bending support for the cementitious plate in both vertical and horizontal directions, wherein each of the hat-section channels includes a substantially flat base member, side members extending upwardly from opposite sides of the base member, and flanges extending generally laterally outwardly from the side members, respectively, for coupling to the underside of the cementitious plate, without interfering with its shear or stress strength, wherein the cementitious plate includes protrusion edges at distal ends to hide the underside of the stiffener system, and wherein the stiffener grid is made of a metal sheet stamped, casted or assembled from multiple hat-section channels into a single piece in a predetermined shape having multiple hat-section channels disposed on the cementitious plate to enhance stiffness and bending strengths of the modular panel, each of which includes attachment means to attach to another modular panel, via a tougue and groove interlocking connection, and selected openings along the hat-section channels to latch on corresponding hooks or fastening clips on a track system for easy installation.

2. The modular panel as claimed in claim 1, wherein the cementitious plate is made from one of fiber-reinforced cement, concrete, gypsum, and wood fibers mixed in a cementitious material.

3. The modular panel as claimed in claim 1, wherein the stiffener system comprises a stiffener grid made of a metal sheet stamped, casted or assembled from multiple hat-section channels into a single piece having multiple hat-section channels disposed on the cementitious plate to enhance stiffness and bending strengths of the modular panel, and a metal mesh or wire cloth attached to the flanges of the hat-section channels of the stiffener grid, via tabs projected from the flanges of the hat-section channels of the stiffener grid.

4. The modular panel as claimed in claim 1, wherein the stiffener system is made of a metal sheet stamped, casted or assembled from multiple hat-section channels into a single piece in a predetermined shape having multiple hat-section channels disposed on the underside of the cementitious plate to enhance stiffness and bending strengths of the modular panel.

5. The modular panel as claimed in claim 1, wherein the stiffener system is provided with a sheet of expanded metal mesh, and a plurality of compression blocks inserted at respective corners and at a center of the stiffener system below the sheet of expanded metal mesh so as to alleviate the compression force experienced by the stiffener system.

6. The modular panel as claimed in claim 1, wherein the stiffener system corresponds to a stiffener grid having a predetermined dimension, in terms of wall thickness, height, spacing between channels and patterning, depending on load specifications of a particular application.

7. The modular panel as claimed in claim 6, wherein the stiffener grid is joined to the cementitious plate by embedding the flanges of the hat-section channels just below a surface of the underside of the cementitious plate, when the cementitious material is cast into a panel form for curing.

8. The modular panel as claimed in claim 6, wherein the stiffener grid is joined to the cementitious plate by way of the flanges of the channels, via one of fasteners and adhesives.

9. The modular panel as claimed in claim 6, wherein the stiffener grid contains perforations, and a sheet of expanded metal mesh attached to the flanges of the hat-section channels is used to enhance bonding between the stiffener grid and the cementitious plate, when the stiffener grid is joined through curing of a cementitious material forming the cementitious plate, at the flanges of the hat-section channels.

10. A construction panel comprising:

a plate made of a cementitious material;

a stiffener system formed at an underside of the plate, and comprising a plurality of elongated, spaced-apart hat-section channels running vertically and horizontally to provide bending support for the plate in both vertical and horizontal directions, and to provide a mechanism for attaching the panel to a building structure; and a top finishing layer applied to the plate to provide both decorative and durability properties of the surface of the panel;

wherein each of the hat-section channels includes a substantially flat base member, side members extending upwardly from opposite sides of the base member, and flanges extending generally laterally outwardly from the side members, respectively, for coupling to the underside of the plate, without interfering with its shear or stress strength, wherein the plate, the stiffener system and the top finishing layer are integrated to create a single piece, used for modular construction, and wherein the stiffener system further utilizes a track system using one or more tracks provided with fastening clips so that the panel can be snapped or secured onto the track system.

11. The construction panel as claimed in claim 10, wherein the cementitious material is comprised of one of fiber-reinforced cement, concrete, and gypsum.

12. The construction panel as claimed in claim 10, wherein the stiffener system is a stiffener grid made of a metal sheet in a predetermined shape having multiple hat-section channels disposed on the cementitious material to absorb stresses and loads placed on the plate.

13. The construction panel as claimed in claim 12, wherein the stiffener grid has a predetermined dimension, in terms of wall thickness, height, spacing between channels and patterning, depending on load specifications of a particular application.

14. The construction panel as claimed in claim 13, wherein the stiffener grid is provided with a sheet of expanded metal mesh, and a plurality of compression blocks inserted at respective corners and at a center of the stiffener grid below the sheet of expanded metal mesh so as to alleviate stress and compression force, while reinforcing the stiffener grid.

15. The construction panel as claimed in claim 14, wherein the stiffener grid is further provided with a flat metal stock attached to the underside of the hat-section channels so as to reduce the overall stress.

16. A process of fabricating a modular panel, comprising:

forming a plate;

providing a stiffener grid made of a metal sheet having a predetermined shape, at an underside of the plate to increase bending stiffness of the plate without interfering with its shear or stress strength, said stiffener grid including hat-section channels running in vertical and horizontal directions, and compression blocks inserted along the hat-section channels at respective corners and at a center of the stiffener grid below the expanded metal mesh; and applying a top finishing layer to the plate to provide both decorative and durability properties of the modular panel.

17. The process as claimed in claim 16, wherein the plate includes protrusion edges at distal ends to hide the underside of the stiffener grid and to provide an illusion of thickness of the modular panel.

18. The process as claimed in claim 16, further comprising:

attaching a flat metal stock at the underside of the channels of the stiffener grid so as to reduce the overall stress.

19. The modular panel as claimed in claim 1, wherein the stiffener system utilizes a track system using one or more tracks provided with fastening clips so that the panel can be snapped or secured onto the track system.

20. The modular panel as claimed in claim 10, wherein the stiffener system comprises a stiffener grid made of a metal sheet having multiple hat-section channels disposed on the plate to enhance stiffness and bending strengths of the modular panel, and a metal mesh or wire cloth attached to the flanges of the hat-section channels of the stiffener grid, via tabs projected from the flanges of the hat-section channels of the stiffener grid.

21. A panel, comprising:

a plate made of a cementitious material;

a stiffener system formed at an underside of the plate, to increase bending stiffness of the plate and to provide a mechanism for attaching the panel to a building structure; and a top finishing layer applied to the plate to provide both decorative and durability properties of the panel surface;

wherein the stiffener system is provided with a plurality of elongated, spaced-apart hat-section channels running vertically and horizontally to provide bending support for the plate in both vertical and horizontal directions, wherein each of the hat-section channels includes a base member, side members extending upwardly from opposite sides of the base member, and flanges extending generally laterally outwardly from the side members, respectively, for coupling to the underside of the plate, without interfering with its shear or stress strength, wherein the stiffener system is integrated into the plate by embedding the flanges of the hat-section channels of the stiffener system into a cementitious material forming the plate, to create a single, modular piece used for construction, and wherein the stiffener system further utilizes a track system using one or more tracks provided with fastening clips so that the panel can be snapped or secured onto the track system.

22. The panel as claimed in claim 21, wherein the cementitious material is comprised of fiber-reinforced cement, concrete or gypsum.

23. The panel as claimed in claim 21, wherein the plate is comprised of a generally flat gypsum core sandwiched between layers of fiber-reinforced cement, concrete or gypsum.

24. The panel as claimed in claim 21, wherein the plate is made of wood fibers mixed in the cementitious material.

25. The panel as claimed in claim 21, wherein the stiffener system comprises a stiffener grid made of a metal sheet having multiple hat-section channels disposed on the plate to enhance stiffness and bending strengths of the panel, and a metal mesh or wire cloth attached to the flanges of the hat-section channels, via tabs projected from the flanges of the hat-section channels.

26. The panel as claimed in claim 21, wherein the stiffener system is a stiffener grid made of a metal sheet stamped or cast into multiple hat-section channels disposed on the cementitious material to absorb stresses and loads placed on the plate and to reduce the overall weight and thickness of the panel, while increasing stiffness and bending strengths of the panel.

27. The panel as claimed in claim 21, wherein each of the flanges of the hat-section channels contains perforations used to enhance bonding between the stiffener grid and the plate, when the stiffener grid is joined through curing of the cementitious material.

28. A panel comprising:

a plate made of a cementitious material;

a stiffener system formed at an underside of the plate, to reduce the overall weight and thickness of the plate without interfering with its shear or stress strength, while providing a mechanism for attaching the panel to a building structure; and a top finishing layer applied to the plate to provide both decorative and durability properties of the panel surface;

wherein the stiffener system comprises a plurality of elongated, spaced-apart hat-section channels running vertically and horizontally to form a grid pattern and to provide bending support for the plate in both vertical and horizontal directions, and arranged such that, when the panel is cut into two or more sub-panels along a horizontal or vertical direction, a structural integrity of individual sub-panels is maintained; and wherein the stiffener system further utilizes a track system using one or more tracks provided with fastening clips so that the panel can be snapped or secured onto the track system.

29. The panel as claimed in claim 28, wherein the cementitious material is comprised of fiber-reinforced cement, concrete or gypsum.

30. The panel as claimed in claim 28, wherein the plate is comprised of a generally flat gypsum core sandwiched between layers of fiber-reinforced cement, concrete or gypsum.

31. The panel as claimed in claim 28, wherein the stiffener system comprises a stiffener grid made of a metal sheet having multiple hat-section channels disposed on the plate to enhance stiffness and bending strengths of the panel, and a metal mesh or wire cloth attached to a flange of the stiffener grid, via tabs projected from the flange of the stiffener grid.

32. The panel as claimed in claim 28, wherein the plate includes protrusion edges at distal ends to hide the underside of the stiffener system and to provide an illusion of thickness of the panel.

33. The modular panel as claimed in claim 1, wherein the stiffener system comprises a stiffener grid assembled from multiple hat section channels to form a grid pattern.

34. The modular panel as claimed in claim 10, wherein the stiffener system comprises a stiffener grid assembled from multiple hat section channels to form a grid pattern.

* * * * *